United States Patent [19]

Evans

[11] 4,284,296

[45] Aug. 18, 1981

[54] FIRE RESISTANT IDENTIFICATION DEVICE

[76] Inventor: Sara M. Evans, 1595 Odell St., Bronx, N.Y. 10462

[21] Appl. No.: 50,819

[22] Filed: Jun. 21, 1979

[51] Int. Cl.[3] ..... B42D 15/00

[52] U.S. Cl. ..... 283/7; 40/2 R; 40/2.2; 283/21

[58] Field of Search ..... 40/2.2, 2 R, 10 R, 10 A, 40/10 B, 10 C, 10 D; 283/6, 7, 1 R, 18, 19, 20, 21, 22

[56] References Cited

U.S. PATENT DOCUMENTS

| | | | |
|---|---|---|---|
| 1,508,733 | 9/1924 | Trabold | 283/7 X |
| 2,424,621 | 7/1947 | McClatchey, Jr. | 283/18 X |
| 4,031,640 | 6/1977 | Hanna Jr. et al. | 283/7 X |
| 4,168,586 | 9/1979 | Samis | 40/2.2 |
| 4,208,795 | 6/1980 | Mühlemann et al. | 283/7 X |

*Primary Examiner*—Paul A. Bell

*Attorney, Agent, or Firm*—Charles E. Baxley

[57] ABSTRACT

A fire-resistant identification device comprising an asbestos card embossed with identification indicia. The card is enclosed in a fire-resistant ceramic holder. The identification device is for use on passenger and other aircraft, ships, railroads and industrial plants.

5 Claims, 4 Drawing Figures

FIG. 1
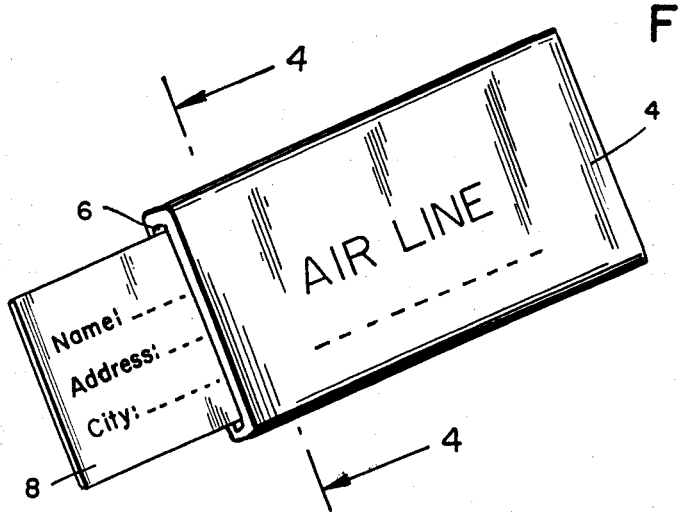
FIG. 2
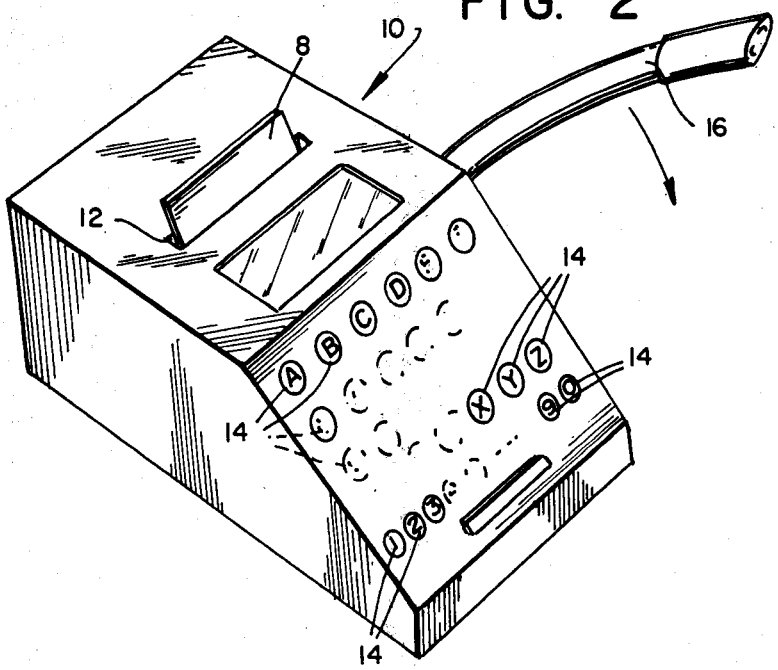
FIG. 4
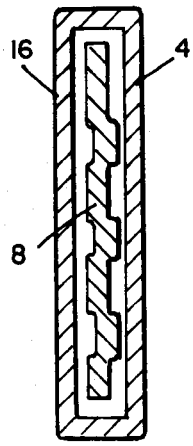
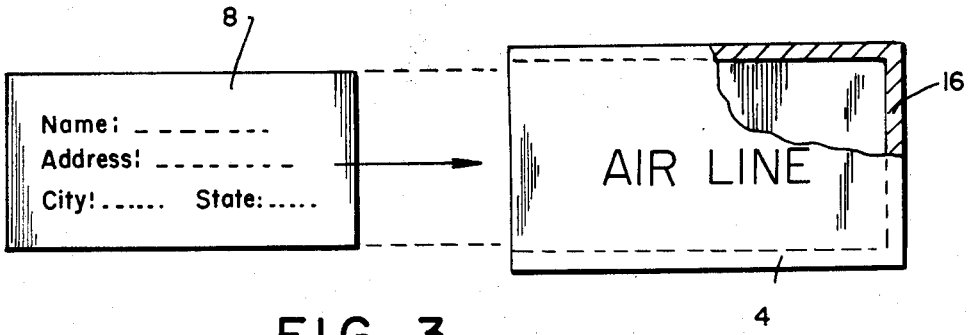
FIG. 3

FIRE RESISTANT IDENTIFICATION DEVICE

BACKGROUND OF THE INVENTION

The inventor relates to identification devices in general and to a fire-resistant identification device in particular.

In many disasters, such as passenger aircraft crashes, industrial, maritime explosions on ships, train wrecks, etc., persons are burned or destroyed beyond recognition. Although many persons carry identification cards of plastic or paper in wallets, these identification devices are burned or destroyed, making it difficult, if not impossible, to identify the corpses.

SUMMARY OF THE INVENTION

It is, therefore, an object of the present invention to provide an identification system which is fire resistant and will make it possible to identify persons who have been killed or severely burned with partial or substantial destruction of facial features or epidermis.

Another object of the invention is to provide flame-resistant identification means which is conveniently carried on a person.

Yet another object of the invention is to provide such identification means which can be easily and quickly prepared for a large number of airline, railroad or ship passengers and industrial workers.

Still another object of the invention is to provide such identification means which is reliable in use and economical to manufacture.

These and other objects of the invention will become apparent from the following description and accompanying drawing, illustrating a preferred embodiment of the invention.

BRIEF DESCRIPTION OF THE DRAWING

FIG. 1 is a perspective view of the identification device.

FIG. 2 illustrates the method of preparing the identification device.

FIG. 3 is a partially cut away top plan view thereof, and

FIG. 4 is a cross-section taken on line 4—4 of FIG. 1.

DETAILED DESCRIPTION OF THE DRAWING

Referring now to the drawing in detail, the identification device comprises a case 4 flameproof ceramic material such as, for example, a material used in cooking dishes known as "Corningware", which is flameproof at 1,000° Farenheit and also "Vycor" 7913 by Corning Glass Works, flameproof at 1650° F. and is formed with an open end 6, through which is inserted an identification card 8 made as a wafer 8 of pressed asbestos, of a predetermined thickness embossed with the name of the passenger, as shown in the figure. The embossing of the identification card may be performed by an embossing machine of the type shown in FIG. 2, wherein such machine is shown as manually operated for the sake of simplicity. In practice, such embossing identification machines are electrically operated and are employed to emboss identification cards of many kinds, such as credit cards, security pass cards, and the like. As seen in FIG. 2, a blank asbestos card is inserted in slot 12 and name, address and other information are embossed thereon by pressing the desired keys, such as 4 and pushing down lever 16, or, in the case of an electrical embossing machine (not shown), by pushing down an appropriate operating key. The embossed card 8 is then removed and inserted in the card case 4 by sliding it in as shown in FIG. 3. A cross-section of the identification card 8 after embossing and the container 4 made of fireproof ceramic material 16 is shown in FIG. 4. The case may be imprinted, if desired, by the airline's name, insignia, etc.

The inventive device is not limited to airline passengers' use, but is also useful on railroads ships and factories.

In use, when the passenger requests a reservation, he is usually given a flight number. When he receives his ticket, he receives the fire-resistant identification device with his name, address, etc., embossed on the asbestos card in the ceramic holder. The card has been already prepared from the information given by him or her while making the reservation. When the passenger boards the plane the steward or stewardess checks to see if the passenger has the proper fire-resistant identification device.

A similar procedure can be used with ship passengers.

Likewise, workers at industrial plants can be issued such identification devices which may be presented at the entrance, to be checked by a plant guard.

I claim:

1. The method of making a fire resistant identification device comprising providing a card of asbestos, embossing identification information thereon, providing a case of fire resistant substance for the card and enclosing the card in the case.

2. A fire-resistant body carried identification device, comprising in combination, a card of fire resistant substance bearing identification indicia, said card being enclosed in a case of fire-resistant material, said card being formed of asbestos.

3. The device of claim 1, wherein said fire-resistant material is ceramic.

4. The device of claim 3, wherein said ceramic is flame resistant at 1,000 Faherenheit.

5. The device of claim 1, wherein said fire resistant substance is flame proof at 1650° F.

* * * * *